United States Patent [19]

Jaromin et al.

[11] 4,218,095

[45] Aug. 19, 1980

[54] MINING UNIT OF COAL COMBINES

[75] Inventors: Zygmunt Jaromin, Katowice; Bolesław Szymczyk, Rybnik; Andrzej Błażewicz, Tychy; Klemens Pilarski, Gliwice, all of Poland

[73] Assignee: Centrainy Osrodek Projektowo-Konstrukoyjny Maszyn Gorniczych "KOMAG", Gliwice, Poland

[21] Appl. No.: 11,706

[22] Filed: Feb. 12, 1979

[30] Foreign Application Priority Data

Feb. 23, 1978 [PL] Poland ..... 204897

[51] Int. Cl.[3] ..... E21C 27/24; E21C 35/20

[52] U.S. Cl. ..... 299/87; 299/89

[58] Field of Search ..... 299/81, 87, 89, 43

[56] References Cited

U.S. PATENT DOCUMENTS 3,085,795 4/1963 Snipe et al. ..... 299/53 X 3,904,246 9/1975 Gandy et al. ..... 299/81

FOREIGN PATENT DOCUMENTS 45637 1/1961 Poland ..... 299/89

56521 12/1968 Poland ..... 299/43

93244 12/1977 Poland .

985678 3/1965 United Kingdom ..... 299/89

1349873 4/1974 United Kingdom ..... 299/87

*Primary Examiner*—Ernest R. Purser

*Attorney, Agent, or Firm*—Haseltine, Lake & Waters

[57] ABSTRACT

A mining unit for a coal combine comprising a cylinder having a cap plate and helically wound panels on the cylinder. The edges of the plate and the panels are provided with cutter holders. The perimeter of the panels project beyond the edge of the cylinder in the direction of the combine body forming a conical profile. The cylinder overlaps the body of the combine. An element mounting the unit on a drive shaft of the combine is situated inside the cylinder so as to be partly within the region of the cap plate.

6 Claims, 2 Drawing Figures

MINING UNIT OF COAL COMBINES

Field of the Invention

The invention relates to a mining unit of coal combines which has a profile of a cylinder consisting of a cap plate and panels which are wound helically and whose edges are provided with cutters. The mining unit is designed especially for arm-type long-wall combines.

Prior Art

There is a mining unit known from the Polish patent specification No. 93244 which has the profile of a cylinder formed by a cap plate and helically wound panels. The cap plate and the helically wound panels are mounted on the cylinder. Inside the cylinder there is a hub by means of which the unit is mounted on the transmission shaft of the combine. The helically wound panels are provided on their perimeters with cutters which mine the coal during the rotation of the unit. The chunks of mined coal fall into the spaces between the helically wound panels. Due to helical arrangement of the panels the coal chunks are transported parallel to the axis of the unit, from the mining area towards the conveyor on which the combine advances. The capacity of the unit, i.e. the quantity of the crushed coal held within the space between the panels, depends on the outer diameter of the unit and on the diameter of the cylinder. The greater the capacity of the unit, the more efficient the removal of coal from the mining area onto the conveyor. The diameter of the cylinder determines the capacity of the unit, but it depends on the shape of this part of the combine with which it cooperates. The mining unit should reach the wall of the combine as close as possible, i.e. the distance between the edge of the mining unit and the conveyor should be as small as possible.

A disadvantage of the known mining unit is the relatively large distance between the edge of the unit and the edge of the conveyor, because the edge of the mining unit reaches only as far as the wall of the combine.

Summary of the Invention

An object of the invention is to provide a mining unit of coal combines, which transports the coal along its axis to a location as close to the conveyor as possible, the transporting capacity of the mining unit being high.

The aforesaid object has been achieved in the mining unit according to the invention by the arrangement wherein the ends of the helically wound panels are projected onto their perimeter, beyond the cylinder on which they are mounted. Moreover, the element contained inside the cylinder and designed for mounting the mining unit on the shaft of the combine, is partly shifted into the region of the side-wall disc, the interior of the cylinder from the side of the combine body being designed so that the combine body can be partly included therein.

The advantage of the mining unit according to the invention is that the edge of the mining unit is close to the conveyor, which facilitates loading of the coal upon the conveyor.

Brief Description of the Drawings

The invention is illustrated with reference to in drawing, wherein.

Detailed Description

Figure 1:
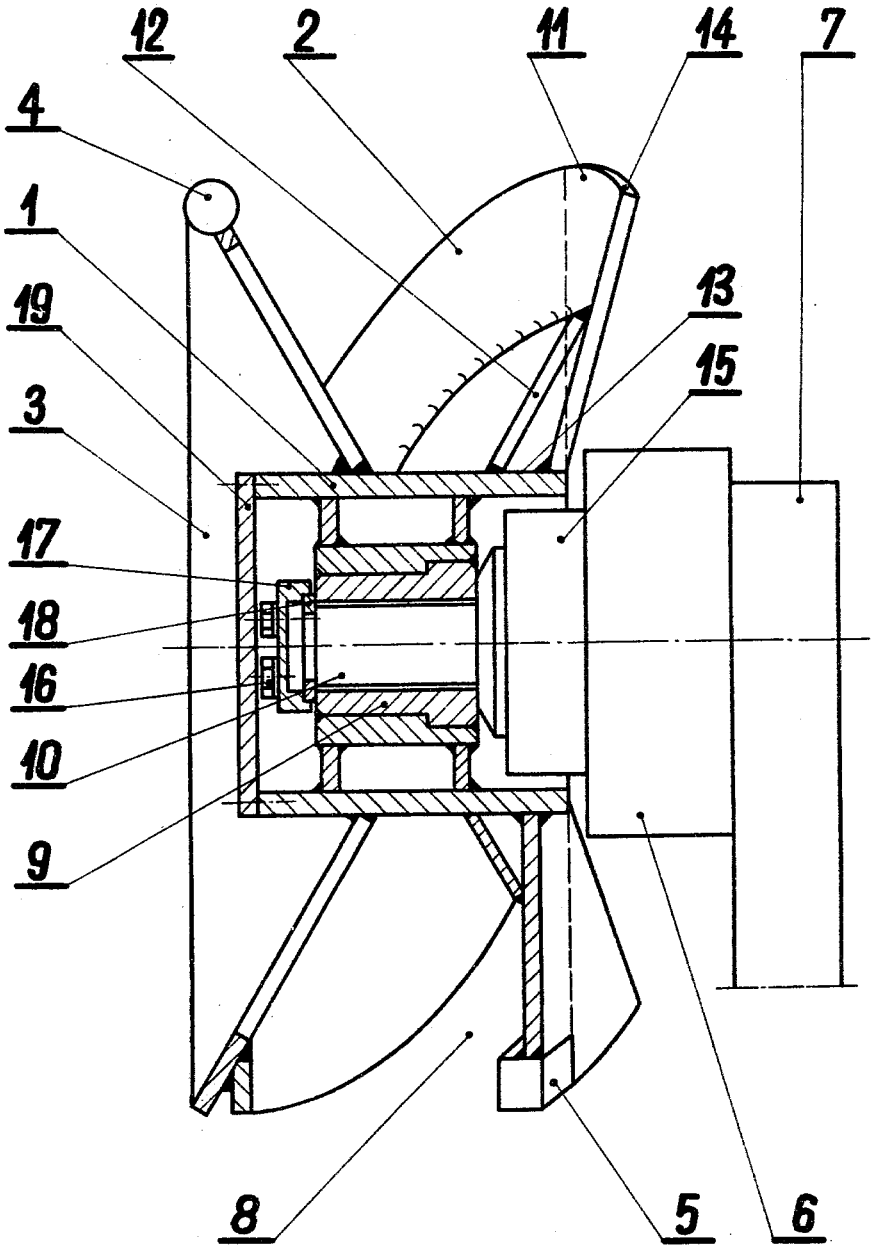
FIG. 1 is a longitudinal section through the mining unit.
Figure 2:
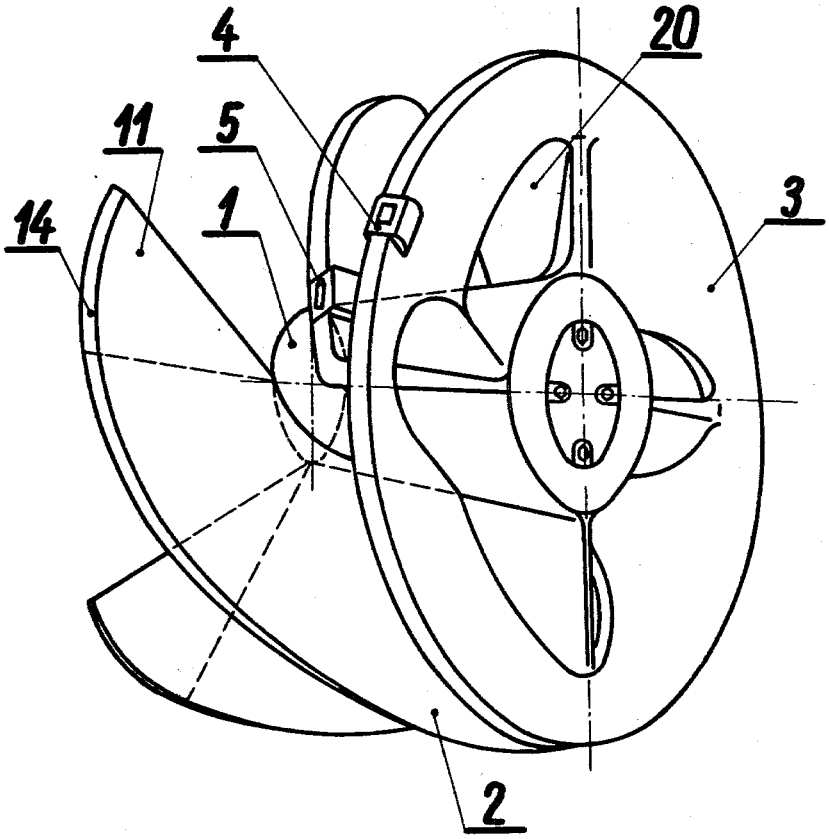
FIG. 2 is a front prespective view thereof.

The cylinder 1 contains an element 9 with a splined slot. By means of the element 9 the mining unit is mounted on the shaft 10 of the combine and is fixed to the shaft by screws 16 passing through sleeves 17 and 18. The interior of the cylinder 1 is closed at the front by means of a plate 19. On the outer surface of the cylinder 1 there is a cap plate 3 shaped, in a special design, as a frustrum of a cone directed with its bigger base towards the body of the coal to be mined. The cap plate 3 has, on its perimeter, holders 4 on which cutters are mounted. The cap plate 3 is provided with slots 20 through which the winning (cut coal) is introduced into the spaces 8. The cap plate 3 is mounted on the cylinder 1 by its smaller base so that the element 9 is situated partly in the region of the cap plate 3. Additionally, on the cylinder 1 of the mining unit are mounted helically wound panels a. On the perimeter 14 of the panels 2 are holders 5 in which mining cutters are mounted. The spaces 8 are formed between the helically wound panels 2. The outer edges of the panels 2, of diameter 14, project beyond the edge of the cylinder 1, whereas the inner edge of the panels 2, of diameter 13, only reach the edge of the cylinder 1. Due to this, the panels 2 have a conical profile 11 projecting beyond the cylinder 1. The panels 2 are reinforced with fins 12 one edge of which contacts the panels 2 and the other the cylinder 1. The interior of the cylinder 1 from the side of the body 6, 7, 15 of the combine, in a special design of the body of the combine arm, is shaped so that the cylinder 1 contains a fragment 15 of the body 6, 7, 15.

In the drawing is seen an arm 7 of the combine and bodies 6, 15 containing transmission gears and bearings of the shaft 10.

The working unit spins on the shaft 10 and simultaneously performs translatory motion crosswise in relation to the axis of spinning, together with the whole combine. Rotational and translatory motion of the unit causes the cutters mounted in holders 4 and 5 to form coal chunks which fall down and fill spaces 8. Under the effect of the rotational motion of the helically wound panels 2, the winning which fills spaces 8 is transported along the unit in the direction of the body 6, 7, 15. Since the conical profile 11 protrudes beyond the cylinder 1, the winning from the spaces 8 leaves the unit at a place close to the conveyor (not shown in the drawing) situated beyond the arm.

What is claimed is:

1. A mining unit of a coal combine, comprising a cylinder, a cap plate on said cylinder, and helical panels on said cylinder, said cap plate and said helical panels being mounted with their inner diameters on said cylinder, said combine including a body with a protruding portion extending within said cylinder, and a shaft extending from said protruding portion, a hub secured to and mounted inside said cylinder on said shaft, said cap plate having a wall of conical form with an apex directed towards the combine, the conical wall of said cap plate being provided with large slots connecting the interior of the cone with a space between the helical panels, said cylinder protruding beyond said hub towards the combine and supporting the helical panels, which protrude above the body of the combine, said panels having triangular surfaces protruding beyond the edge of the cylinder, said triangular surfaces extending above the body of the combine beyond the cylinder, the triangular surfaces having an apex on the surface of the cylinder and a base which lies on the perimeter of the helical panel, and a plate between the helical panel, and the cylinder covering corners formed by the helical panel and the cylinder.

2. A mining unit as claimed in claim 1 comprising a spline connection between said shaft and said cylinder.

3. A mining unit as claimed in claim 1 wherein said protruding portion contains transmission gears and bearings for said shaft.

4. A mining unit as claimed in claim 1 comprising cutting means on said cap plate and helical panels at the periphery thereof.

5. A mining unit as claimed in claim 1 wherein said slots are of U-shape.

6. A mining unit as claimed in claim 1 wherein the helical panels have an end inner edge located at the edge of said cylinder and an end outer edge located axially beyond the edge of the cylinder and above the body of the combine.

* * * * *